US005850871A

United States Patent [19]

Sears, Jr.

[11] Patent Number: 5,850,871

[45] Date of Patent: Dec. 22, 1998

[54] FOOT GUIDE AND CONTROL SYSTEM FOR CONTINUOUS CASTING MACHINE

[75] Inventor: James Bernard Sears, Jr., Riverview, Mich.

[73] Assignee: AG Industries, Inc., Coraopolis, Pa.

[21] Appl. No.: 627,450

[22] Filed: Apr. 4, 1996

[51] Int. Cl.[6] ..... B22D 11/04; B22D 11/16; B22D 11/20; B22D 11/22

[52] U.S. Cl. ..... 164/451; 164/150.1; 164/151; 164/154.1; 164/154.8; 164/413; 164/414; 164/436; 164/452; 164/454; 164/455; 164/491

[58] Field of Search ..... 164/451, 452, 164/453, 454, 455, 150.1, 151, 154.8, 155.3, 154.1, 413, 414, 436, 491

[56] References Cited

U.S. PATENT DOCUMENTS

| | | | |
|---|---|---|---|
| 2,284,503 | 5/1942 | Willaims . | |
| 2,770,021 | 11/1956 | Harter, Jr. et al. . | |
| 2,895,190 | 7/1959 | Bungeroth et al. . | |
| 2,988,790 | 6/1961 | Rustemeyer et al. . | |
| 3,015,862 | 1/1962 | Rustemeyer et al. . | |
| 3,263,284 | 8/1966 | Orr et al. . | |
| 3,314,115 | 4/1967 | Saunders et al. . | |
| 3,370,642 | 2/1968 | Meier et al. . | |
| 3,430,684 | 3/1969 | Babel et al. . | |
| 3,559,719 | 2/1971 | Rossi . | |
| 3,580,327 | 5/1971 | Khimich et al. . | |
| 3,735,848 | 5/1973 | Bode, Jr. et al. . | |
| 3,753,459 | 8/1973 | Burkhardt et al. . | |
| 3,930,534 | 1/1976 | Wünnenberg et al. . | |
| 4,015,656 | 4/1977 | Scheinecker et al. . | |
| 4,056,140 | 11/1977 | Ives et al. | 164/454 |
| 4,090,549 | 5/1978 | Ives et al. | 164/451 |
| 4,136,728 | 1/1979 | Schmid | 164/444 |
| 4,245,691 | 1/1981 | Hargassner et al. | 164/436 |
| 4,256,169 | 3/1981 | Ives | 164/448 |
| 4,300,619 | 11/1981 | Scheurecker | 164/448 |
| 4,479,529 | 10/1984 | Scheurecker | 164/442 |
| 4,488,591 | 12/1984 | Hoffmann et al. | 164/442 |
| 4,590,986 | 5/1986 | Scholz et al. | 164/448 |
| 4,669,526 | 6/1987 | Hury | 164/418 |
| 4,685,506 | 8/1987 | Fasano | 164/416 |
| 4,721,151 | 1/1988 | Streubel | 164/418 |
| 4,905,754 | 3/1990 | Kimura et al. | 164/442 |
| 5,490,555 | 2/1996 | Korpela | 164/454 |

FOREIGN PATENT DOCUMENTS

| | | | |
|---|---|---|---|
| 0102345 | 3/1984 | European Pat. Off. . | |
| 2 445 744 | 8/1980 | France . | |
| 51-20967 | 6/1976 | Japan . | |
| 58-55159 | 4/1983 | Japan | 164/451 |
| 6-292959 | 10/1994 | Japan | 164/452 |
| 395 439 | 12/1965 | Switzerland . | |
| 582045 | 11/1977 | U.S.S.R. . | |
| 1118451 | 7/1968 | United Kingdom . | |
| 1158172 | 7/1969 | United Kingdom . | |

OTHER PUBLICATIONS

Translation of Japanese Patent Publication 58–55159 Published Apr. 1, 1983.

Translation of Japanese Patent Publication 6–292959 Published Oct. 21, 1994.

*Primary Examiner*—J. Reed Batten, Jr.

*Attorney, Agent, or Firm*—Knoble & Yoshida LLC

[57] ABSTRACT

An improved continuous casting mold and foot guide assembly includes a mold having a casting passage defined therein, a frame member, mounting structure for mounting the frame member to the mold for relative movement toward and away from an axis of the casting passage, and a strand support member for providing support to a strand of continuously cast material as it emerges from the casting passage. Biasing structure is provided for biasing the frame member toward the axis of the casting passage and, advantageously, is positioned so as not to occupy space that is behind the frame member. As a result, the assembly is compatible with all models of casting machines and will be less susceptible to degradation as a result of radiant heat and steam that is emitted from the strand during operation. In addition, a load cell is provided for monitoring the amount of relative force between the frame member and the strand during operation. This information is recorded and analyzed, and can be used to alert an operator of an emergency condition, or to adjust certain parameters of the process, such as width adjustment speed, mold wall inclination, or coolant supply to the mold or to the strand.

43 Claims, 2 Drawing Sheets

TEMPERATURE
FRICTION
OPERATOR CONTROL SYSTEM
66
62
48
INCLINOMETER
LOAD FORCE
56
64
68
SPRAY CONTROL
CPU
DATA RECORDER
58
70
COOLANT FLOW
72
60
78
WIDTH
MACHINE CONTROL
SPEED
WIDTH CHANGE SPEED
84
74
RAM MOVEMENTS
INCLINATION
80
82
SHUT-OFF

FOOT GUIDE AND CONTROL SYSTEM FOR CONTINUOUS CASTING MACHINE

BACKGROUND OF THE INVENTION

1. Field of the Invention

This invention relates generally to the field of continuous casting of metals, and more specifically to an improved foot guide or support assembly for an adjustable mold in a continuous casting machine.

2. Description of the Prior Art

Production of metals by use of the continuous casting technique has been increasing since its large-scale introduction about thirty years ago, and now accounts for a large percentage of the volume of steel, among other metals, produced each year worldwide. It is well known that continuous casting machines typically include a mold that has two essentially parallel and opposed wide walls, and two essentially parallel opposed narrow walls that cooperate with the wide walls to define a casting passage of rectangular cross section. Molten metal is supplied continuously into a top end of the casting passage, and the mold is designed to cool the metal so that an outer skin forms before the so-formed slab or strand exits a bottom of the casting passage. The strand is further cooled by spraying as it travels away from the mold, until it becomes completely solidified. It may then be processed further into an intermediate or finished metal product, such as steel plate, sheeting or coils by traditional techniques such as rolling.

In many cases, a customer's needs will require that a strand or slab be formed to a specific width. For example, a platemaker might require a strand of a certain width because it will yield a plate that has a desired dimension when it is rolled to an intended thickness. Unfortunately, a small order of a nonstandard width by a customer may be such that the casting of an entire slab, which would include all of the molten metal that could be held in a supply ladle of the casting machine, would result in excess production and inefficiency.

To address such situations, continuous casting machines that are width-adjustable during operation have been developed and are in common use in the industry. Such molds, which are referred to as "remotely adjustable," are designed in such a manner that the narrow walls may be moved towards and away from one another without stopping movement of the slab, i.e., without interrupting the casting operation.

The strand or slab has a very thin skin when it initially forms in the mold. Rupture of the skin during a width change must be avoided at all costs because it can cause a condition known as a breakout, i.e., where molten metal escapes through the skin beneath the mold. A severe breakout can encase portions of the machine that are in its path in molten metal, rendering those components unusable and requiring them to be replaced or reconditioned. When this happens, the casting machine might be inoperative for an extended length of time, which is a significant cost to a steelmaker, perhaps as much as fifteen thousand dollars per hour. The assignee of this invention, Gladwin Corporation, is the largest North American provider of maintenance and repair services for continuous casting machines and is intimately familiar with the problems that are associated with breakouts.

To avoid rupturing the skin of the strand or slab, the narrow walls must be moved relatively slowly so that they provide constant support to the narrow faces of the slab.

Therefore, it takes a certain amount of time to effect the width change. Since the slab continues moving while the width change takes place, the portion of the slab which passes through the mold during the period required to carry out the width change is tapered.

Due to the initial weakness of its skin, the slab must be supported even after it leaves the mold. To achieve this, a series of support zones are typically arranged downstream of the mold. Each support zone includes two essentially parallel wide sides made up of cooling grids, cooling plates or rollers which engage the wide faces of the slab. The first support zone further includes two essentially parallel narrow sides likewise which are also made up of cooling grids, cooling plates or rollers. The first support zone is particularly critical since the skin of the slab has not had a chance to develop significantly and therefore requires substantial support. During normal operation, the four faces of the slab are in contact with the respective sides of the first support zone.

For width adjustment as discussed above, the narrow sides of the first support zone are usually made movable towards and away from one another. However, it is extremely difficult to synchronize the movements of the narrow sides of the first support zone with those of the narrow walls of the mold. Furthermore, the narrow sides of the first support zone are not designed to be inclined, so they are unable to conform to the taper of the slab during a width change. For these reasons, it used to be the practice to back the narrow sides of the first support zone away from the slab while a width change is taking place. This left the narrow faces of the slab with no support. The result was a bulging of the narrow faces of the slab caused by the pressure of the molten metal constituting the core of the slab. Bulging is undesirable from a quality standpoint and, in addition, increases the risk of a breakout. The extent of bulging can be decreased by reducing the casting speed. However, this reduces the output of the continuous casting apparatus.

To address this problem, attempts have been made to provide self-adjusting support to the strand during a width change. For example, U.S. Pat. No. 4,669,526 to Hury discloses a strand support that constitutes a downward extension of the narrowface wall and is pivotably mounted to the narrowface support. A compression spring and linkage is connected to a bottom end of the strand support to urge it toward the other support. As the taper of the strand changes during a width change, the bias provided by the compression springs will maintain the strand support in contact with the strand at a force that is substantially constant.

Unfortunately, the linkage disclosed by the Hury patent takes up a great deal of space in the area that is immediately behind the strand support, which renders it unusable in some casting machines. In addition, the linkage and compression spring in the Hury system will be exposed to a great deal of radiant heat and superheated steam from the strand during operation of the machine, which might lead to bending of the linkage, corrosion, a loss of elasticity in the spring, and premature failure.

Adjustment of the first zone, the mold, and other components of a continuous casting machine during a width change is a complex procedure that can be susceptible to less than optimal results even in the hands of an experienced operator. Anything that can be done to aid the operator during this procedure and reduce the potential for human error is needed and would be looked upon with favor by the industry.

SUMMARY OF THE INVENTION

Accordingly, it is an object of the invention to provide an improved system and method for guiding and supporting a strand in a continuous casting machine that is less cumbersome and less susceptible to degradation from radiant heat and superheated steam than mechanisms previously arrived at for this purpose in the past have been.

It is further an object of the invention to provide an improved system and process for continuous casting that is automated to the greatest extent possible in order to aid the operator, reducing the potential for human error.

In order to achieve the above and other objects of the invention, an improved continuous casting mold and foot guide assembly includes, according to a first aspect of the invention, a mold having a casting passage defined therein; a frame member; mounting structure for mounting the frame member to the mold for relative movement toward and away from an axis of the casting passage; strand support structure on the frame member for providing support to a strand of continuously cast material as it emerges from the casting passage; and biasing structure for biasing the frame member toward the axis of the casting passage, the biasing structure being positioned so as not to occupy space that is behind the frame member, whereby the assembly will be compatible with all models of casting machines and will be less susceptible to degradation as a result of radiant heat and superheated steam that is emitted from the strand during operation.

According to a second aspect of the invention, a process control-compatible continuous casting mold and foot guide assembly includes a mold having a casting passage defined therein; a frame member; mounting structure for mounting the frame member to the mold for relative movement toward and away from an axis of the casting passage; strand support structure on the frame member for providing support to a strand of continuously cast material as it emerges from the casting passage; and force monitoring structure for monitoring the amount of relative force between the frame member and the strand during operation.

According to a third aspect of the invention, a method of operating a continuous casting machine of the type that has an adjustable width mold that defines a casting passage therein and a foot guide assembly that is proximate to the mold, includes steps of: (a) forming a strand within the casting passage of the mold; (b) guiding the strand with the foot guide assembly after the strand emerges from the mold; (c) monitoring the relative force that exists between the strand and the foot guide assembly during operation; (d) analyzing the information obtained in step (c) to determine if a condition exists; and (e) alerting an operator to the condition if it is determined to exist.

According to a fourth aspect of the invention, a method of operating a continuous casting machine of the type that has an adjustable width mold that defines a casting passage therein and a foot guide assembly that is proximate to the mold, includes steps of: (a) forming a strand within the casting passage of the mold; (b) guiding the strand with the foot guide assembly after the strand emerges from the mold; (c) monitoring the relative force that exists between the strand and the foot guide assembly during operation; (d) analyzing the information obtained in step (c) to determine if a condition exists; and (e) modifying operation of the casting machine in response to the analysis that is performed in step (d).

According to a fifth aspect of the invention, a system for operating a continuous casting machine of the type that has an adjustable width mold that defines a casting passage therein and a foot guide assembly that is proximate to the mold includes monitoring structure for monitoring the relative force that exists between the strand and the foot guide assembly during operation; analyzing structure for analyzing the information obtained from the monitoring structure to determine if a condition exists; and alerting structure for alerting an operator to the condition if it is determined to exist.

According to a sixth aspect of the invention, a system for operating a continuous casting machine of the type that has an adjustable width mold that defines a casting passage therein and a foot guide assembly that is proximate to the mold, includes monitoring structure for monitoring the relative force that exists between the strand and the foot guide assembly during operation; analyzing structure for analyzing the information obtained by the monitoring structure to determine if a condition exists; and process control structure for modifying operation of the casting machine in response to the analysis that is performed by the analyzing structure.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
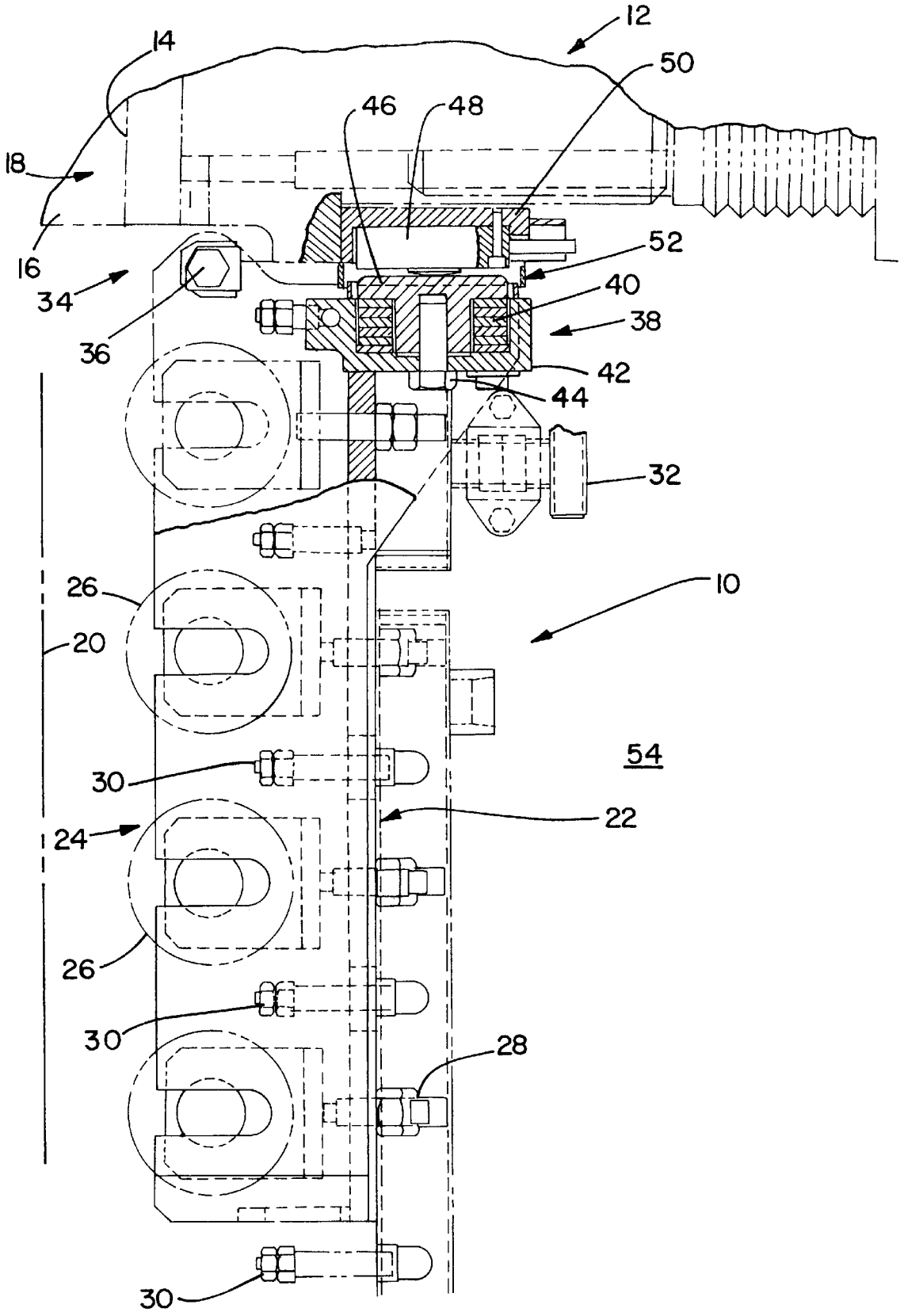
FIG. 1 is a partially diagrammatical side elevational view of an improved continuous casting mold and foot guide assembly that is constructed according to a preferred embodiment of the invention.

Referring now to the drawings, wherein like reference numerals designate corresponding structure throughout the views, and referring in particular to FIG. 1, an improved continuous casting mold and foot guide assembly 10 includes, according to a preferred embodiment of the invention, a continuous casting mold 12 that has a casting passage 18 defined therein by a pair of narrowface walls 14 and a pair of wideface walls 16, which are arranged in a manner that is known in this area of technology. Casting passage 18 has a central axis, which is indicated by reference numeral 20 in FIG. 1.

Referring again to FIG. 1, improved mold and foot guide assembly 10 further includes a frame member 22 that is arranged to depend downwardly from a lower surface of the mold 12, as may be seen in the drawing. The purpose of frame member 22 is to hold and support a strand support structure 24. In the preferred embodiment, strand support structure 24 includes a plurality of roller members 26, each of which is adjustably mounted along an axis that is substantially perpendicular to the axis 20 of casting passage 18 by individual adjustment mechanisms 28, as may be seen in FIG. 1. Alternatively, strand support structure 24 could include one or more skid plates, or anything else that could provide sufficient support to a strand emerging from casting passage 18 in order to obviate the problems of bulging, etc., that are discussed above.

As is conventional in this area of technology, a number of spray nozzles 30 are also attached to the frame member 22 for spraying cooling water on to the strand as it passes by the roller members 26. Water is supplied to the nozzles 30 by one or more water supply pipes 32, the specific arrangement of which is not essential to the invention.

Looking again to FIG. 1, it will be seen that a mounting mechanism 34 is provided for mounting the frame member 22 to the mold 12 so that the frame member 22 can move relatively toward and away from the axis 20 of the casting passage 18. In the preferred embodiment, mounting mechanism 34 is embodied as a pivot joint 36 that constrains the frame member 22 to pivot in an arc that has a center point that is spaced slightly from the lower edge of the narrowface wall 14. The spacing is such that the outer edge of roller members 26 are substantially parallel to the surface of narrowface wall 14 when the frame member 22 is not deflected away from the strand that emerges from the casting passage 18. The upper rolls may protrude inwardly toward the strand to a degree that is slightly greater than the lower rolls, as is known in the industry.

According to one advantageous feature of the invention, the pivot joint 36 is preferably constructed so as to permit the frame member 22 to break away from the mold 12 when a predetermined force is applied to the frame member 22, which will allow the frame member 22 to separate from the mold 12 after being fused to the mold 12 in the event of a breakout or similar emergency. The requisite force to cause pivot joint 36 to break away is preferably a force having a downward component, i.e. parallel to the access 20 of casting passage 18, that is within the range of approximately 75,000 pounds of force to about 150,000 pounds of force. More preferably, the predetermined force at which pivot joint 36 is designed to fail is within the range of approximately 90,000 pounds of force to about 120,000 pounds of force. The inventor believes that this facet of the invention will provide a significant saving of time and labor at times when it is necessary to return a continuous casting machine to operability after an emergency, such as when repairing and reconditioning after a breakout.

Another important aspect of the invention involves the provision of a biasing structure 38 to bias the frame member 22 toward the axis 20 of the casting passage 18 during operation. Advantageously, biasing structure 38 is positioned so as not to occupy space 54 that is behind the frame member 22. This makes the assembly 10 compatible with all models of continuous casting machines, as well as being less susceptable to degradation as a result of radiant heat and superheated steam that is emitted from the strand during operation.

Referring again to FIG. 1, it will be seen that the biasing structure 38 is preferably styled as a compression spring 40 that consists of a plurality of resilient disks that are designed for elastic deflection, the details of which are generally known. For example, such a spring is commercially available from Adolf Schnorr GmbH & Co. KG. The discs are positioned in a housing 42 that is defined in the frame member 22, and are retained within the housing 42 by a retainer member 46 that is secured to the housing 42 by means of a precompression adjustment bolt 44. By turning the precompression adjustment bolt 44, an operator can increase or reduce the range and amount of bias that is provided by the biasing structure 38 to the frame member 22. Alternatively, biasing structure 38 could be something other than a compression spring, such as a tension spring, a torsion spring, or a pneumatic or hydraulic biasing arrangement.

As may further be seen FIG. 1, an electronic load cell 48 is positioned opposite the upper surface of the retainer member 46 in a load cell housing 50 that is defined in the mold 12. The purpose of load cell 48 is to monitor the amount of relative force that exists between the frame member 22 and the mold 12 during operation. Since this force will be directly proportional to the force that is exerted on the frame member 22 by the strand during operation, load cell 48 indirectly measures the relative pressure between the frame member 22, or specifically the strand support structure 24, and the strand of the continuously cast material that emerges from the casting passage 18.

As may be seen in FIG. 1, the housing 42 that is provided in the frame member 22 for compression spring 40 and the load cell housing 50 in mold 12 combine to form a telescoping shroud 52 that protects the biasing structure 38 and the load cell 48 against contamination and against radiant heat and superheated steam that is emitted from the strand during operation. As a result, the biasing structure 38 is nearly completely insulated from radiant heat and/or superheated steam, giving it a longevity and reliability that eluded previous generation systems.

Figure 2:
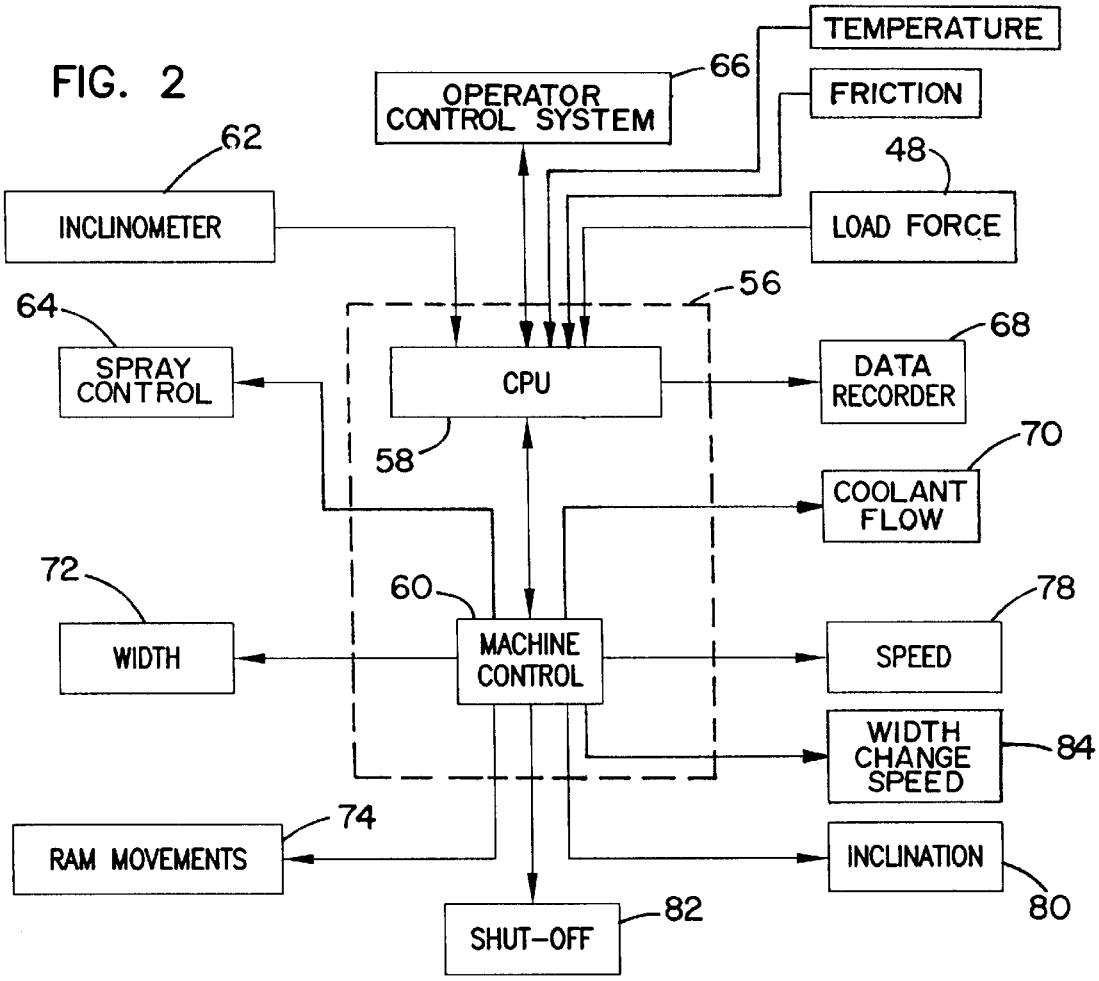
FIG. 2 is a schematic diagram depicting a control system for the assembly that is depicted in FIG. 1.

A control 56 for operating a system according to the invention is shown schematically in FIG. 2. Control 56 may consist of a CPU 58 that is unique to the invention and a machine control 60 for a continuous casting machine that is of conventional design and that is in two-way communication with the CPU 58. For example, the machine control 60 may be the type that is provided commercially by GE Fanuc Automation North America Inc., of Charlottesville, Va.

As is known in this area of technology, an inclinometer 62 of conventional design is mounted on one or more faces of the mold 12 for measuring and reporting the inclination of the mold face to the controller 56 through the CPU 58. Information from load cell 48 (which could alternatively be anything else for monitoring the force load) is also collected by the controller 56 through the CPU 58. Controller 56 through CPU 58 is further in two-way communication with an operator control system 66 which includes an operator display and an operator input, which may be for such factors as the speed at which the continuous casting process is performed, the specific grade and type of material that is being cast, the oscillation cycle speed, and other factors that are known in this area of technology. CPU 58 further communicates with a data recorder 58, which my be a chart recorder, for recording information that will be of interest to the technical personnel who are monitoring operation of the system. CPU 58 may also be connected to a temperature sensor for sensing the temperature of the strand as it exits the mold, and a friction sensor for sensing the relative friction between the strand and the mold.

Machine control 60 is connected to control a unit 64 for spraying the strand after it emerges from the cooling passage 18, and to instruct a control 70 that provides coolant flow to the mold 12, to change the width 72 of the mold 12, to control the ram movements 74 of the machine, to control the basic speed 78 of the machine, to modify the inclination 80 of one or more of the mold faces, to actuate a shut off system 82 in the event of an emergency, and to control the rate at which width changes are performed, as is indicated by reference numeral 84 in FIG. 2.

Controller 56 is, through programming of the CPU 58 and machine control 60, constructed and arranged to automate control of the continuous casting system, making it safer, more efficient, and more user-friendly. For example, controller 56 is capable of detecting abnormalities in the drive system for changing the width of the mold. On a typical mold, this drive system will rotate connecting shafts attached to a gearbox mechanism on the mold, which in turn drives the mold faces toward or way from each other. If a drive system component such as a gearbox were to fail, the drive member would still rotate and an encoder which counts revolutions would continue to tell the controller that the mold wall is moving when it is not in fact moving at all. Such situations invariably cause system failure, such as by breakout. Controller 56 is programmed to sense this type of abnormal operational condition in two ways: by sensing, by means of inclinometer 62, that the mold face is at an extreme taper, and by sensing, by means of load cell 48, that the force against the frame has risen to a predetermined maximum. Controller 56 may be programmed to shut off the machine when such a condition is determined to exist.

Controller 56 is programmed to, either automatically or by advising the operator, adjust the speed by which the mold width changes are effected. For example, if while moving outward the load cell 48 reports that the force between the strand and the frame is beneath a predetermined minimum (indicating the potential for bulging, bleeding or breakout), controller 56 may slow the width adjustment process. If, while adjusting to a narrower width, the load cell reports that the force between the strand and the frame is greater than a predetermined maximum, controller 56 will also slow the width adjustment process.

In most machines, the top of the mold wall is started moving slightly before the bottom of the mold wall during a width change. During this process, load cell 48 may inform controller 56 that the tilt at this point has become excessive by reporting a load that is above a predetermined maximum. In addition, the inclinometer 62 would inform controller 56 of the mold's inclination at this point. Controller 56 could control the timing of the relative movements of the top and bottom spindles for controlling the top and bottom of the moldface movements, respectively.

During a normal casting operation, the taper (inclination) setting of the narrowface wall is supposed to keep the end wall member in constant contact with the strand as it transfers heat to the mold liners and shrinks in physical dimension. That taper is usually programmed as a function of the cast width and is commonly described as percentage taper per meter length of copper per width of the product. Normally, mold taper ranges from 0.9% to 1.6%, depending on the shrinkage rate of the product grade being cast. If the taper aim is 1% on an 80 inch wide (top opening) mold with 0.9 meter long copper, taper might be calculated as:

1% divided by 100=0.01×0.9=0.009×80"=0.720" total mold taper
0.360" taper per endwall.

The taper during operation is ideally optimized based upon such variables as the cast speed, the superheat of the steel and the thickness of the copper. In conventional machines, however, such factors are not directly compensated for. Controller 58 is programmed to monitor the load sensed by load cell 48 to determine and control the proper amount of mold taper during operation, which will ensure that there is maximum contact between the strand and the mold and maximum heat transfer to the endwalls. If it senses that the load is above a predetermined maximum at a high speed, it would show that the strand is not cooling and shrinking as quickly as it would at a slower speed. Controller 58 would then decrease the taper until the sensed force is within a predetermined range. Conversely, if the sensed load is beneath a predetermined minimum, controller 58 may be programmed to increase the mold taper. This type of taper control would also be effective when changing from a relatively thin set of mold face copper to a thicker set, or vice versa, or when changing to or from a moldface that has an additional surface coating such as nickel.

In addition to or in lieu of controlling the amount of taper in response to sensed force against the strand support frame, the speed at which the strand is withdrawn from the mold could also be adjusted by controller 58. In other words, instead of adjusting the mold taper to the withdrawal speed, the withdrawal speed (as indicated by reference numeral 78 in FIG. 2) could be adjusted to make the shrinkage rate of the strand ideal for the taper of the mold.

Controller 56 could also be used to adjust the initial setting of the strand support rollers or "passline" with respect to the axis 20 of casting passage 18 and to the strand during operation. Typical settings for such rollers are generally in line with each other, and flush with the plane of the endwall copper surface 14. Each additional roller is usually set back further from passline in a downward direction beneath the mold because there is less heat removal from the strand after the mold than there is in the mold, and less need for taper to accommodate strand shrinkage below the mold.

By monitoring the load on the load cell 48, controller 56 could be used to vary the amount of setback to optimize the spacing of the rollers 26 to the actual position of the strand during casting.

In another embodiment of the invention, wherein a hydraulic cylinder is used in lieu of the biasing mechanism 38, the system could be designed so that the strand is supported by the foot roller assembly at a continuous force regardless of the width of the strand that is being cast. This would be accomplished by adjusting the system hydraulic pressure to maintain a given pressure against the roller system. If the load started to go up because the endwall was being inclined back further at the top, fluid could be drained off. As the load decreased, more fluid could be pumped into a flat, pancake type cylinder that would be positioned where the biasing mechanism is in the illustrated embodiment. A pneumatic system could also be used for this purpose.

Controller 56 could also be programmed to control the shrinkage rate of the strand by adjusting the amount of coolant that is supplied to the mold assembly in response to the load that is sensed by load cell 48. Adjusting the coolant would adjust the heat removal rate that occurs within the mold, and would thereby adjust the amount of shrinkage, preferably to an amount that is consistent with the desired support force between the strand support rollers and the strand.

If the data that is being received from load cell 48 indicates that pressure shifts vary rapidly from, possibly, a very high load to a very low load or (or vice versa), controller 56 may be programmed to conclude that a breakout has occurred, and to shut off the continuous casting machine. If controller 56 detects a series of small load spikes caused by solidified steel which attaches itself to the outer surface of the strand shell, it may conclude that a bleeder condition exists. If this occurs, controller 56 may inform the operator through the operator control system 66 that a problem may exist, so that the operator can visually inspect the strand to determine whether any larger problems are about to occur.

During start up, load cell 48 may also be used by controller 56 to determine if the start up bar is contacting one side of the foot rollers more strenuously than the other side, which would indicate that the start up bar is not sufficiently centered within the mold. Controller 56 could determine this and pass the information along to the operator via the operator controller system 66. During normal operation, the same principle could be used to determine if there is more pressure on one side of the mold than the other, which would indicate that the strand is not centered with respect to the mold. This could indicate that there is uneven spray cooling in the containment section beneath the mold. Controller 56 may detect this condition and report it to the operator via the operator control system 66, and may also be programmed to control the spray downstream of the mold in order to rectify the situation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved continuous casting mold and foot guide assembly, comprising:

a mold having a casting passage defined therein;

a frame member;

mounting means for mounting said frame member to said mold for relative movement toward and away from a longitudinal axis of the casting passage;

strand support means on said frame member for providing support to a strand of continuously cast material as it emerges from the casting passage; and biasing means for biasing said frame member toward the axis of the casting passage, wherein all of said biasing means is positioned so as not to occupy space that is behind said frame member, whereby said assembly will be compatible with all models of casting machines and will be less susceptible to degradation as a result of radiant heat and steam that is emitted from the strand during operation.

2. An assembly according to claim 1, wherein said mounting means comprises a pivot joint for mounting said frame member for pivotal movement with respect to said mold.

3. An assembly according to claim 1, wherein said mounting means is constructed so as to permit said frame member to separate from said mold when a predetermined force is applied to said frame member, whereby said frame member will not be fused to said mold in the event of a breakout.

4. An assembly according to claim 3, wherein the predetermined force is calculated as being substantially parallel to the axis of the casting passage, and is within the range of approximately 75,000 pounds of force to about 150,000 pounds of force.

5. An assembly according to claim 4, wherein the predetermined force is within the range of approximately 90,000 pounds of force to about 120,000 pounds of force.

6. An assembly according to claim 1, wherein said strand support means comprises a plurality of roller members.

7. An assembly according to claim 1, wherein said biasing means is interposed directly between said frame member and said mold, whereby it is not significantly exposed to radiant heat and steam from the strand during operation.

8. An assembly according to claim 7, wherein said biasing means comprises a compression spring.

9. An assembly according to claim 7, further comprising means for adjusting the amount of bias that is provided by said biasing means.

10. An assembly according to claim 1, further comprising means for monitoring the amount of relative force between said frame member and the strand during operation.

11. An assembly according to claim 10, wherein said monitoring means comprises a load cell that is interposed between said frame member and said mold.

12. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists;

(e) alerting an operator to the condition if it is determined to exist; and (f) recording the information obtained in step (c) for future reference by the operator and others.

13. A method according to claim 12, wherein the condition in steps (d) and (e) includes the presence of a bulge in the strand.

14. A method according to claim 12, wherein the condition in steps (d) and (e) includes the presence of a breakout.

15. A method according to claim 12, wherein the condition in steps (d) and (e) includes the presence of a bleeder in the strand.

16. A method according to claim 12, wherein the condition in steps (d) and (e) includes damage to the footguide assembly.

17. A method according to claim 12, wherein the condition in steps (d) and (e) includes the proximity of the strand to a longitudinal axis of the mold.

18. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists; and (e) modifying operation of the casting machine in response to the analysis that is performed in step (d), and wherein step (e) includes a step of adjusting the speed by which a mold width change is made.

19. A method according to claim 18, wherein step (e) includes adjusting the taper of at least one face of the mold.

20. A method according to claim 18, wherein step (e) includes adjusting the spacing of the foot guide assembly to the centerline of the casting passage of the mold.

21. A method according to claim 18, wherein step (e) includes adjusting the flow of coolant to the mold.

22. A method according to claim 18, wherein step (e) includes adjusting the flow of coolant to cooling sprays that are downstream of the mold.

23. A method according to claim 18, wherein step (e) includes adjusting the rate at which the strand is withdrawn from the mold.

24. A system for operating a continuous casting machine that has an adjustable width mold that defines a casting passage therein and a foot guide assembly that is proximate to said mold, comprising:

monitoring means for monitoring the relative force that exists between a strand and the foot guide assembly during operation;

analyzing means for analyzing the information obtained from said monitoring means to determine if a condition exists;

alerting means for alerting an operator to the condition if it is determined to exist; and recording means for recording the information obtained by said monitoring means for future reference by the operator and others.

25. A system according to claim 24, wherein the condition that is determined by said analyzing means includes the presence of a bulge in the strand.

26. A system according to claim 24, wherein the condition that is determined by said analyzing means includes the presence of a breakout.

27. A system according to claim 24, wherein the condition that is determined by said analyzing means includes the presence of a bleeder in the strand.

28. A system according to claim 24, wherein the condition that is determined by said analyzing means includes damage to the footguide assembly.

29. A system according to claim 24, wherein the condition that is determined by said analyzing means includes the proximity of the strand to a longitudinal axis of the mold.

30. A system for operating a continuous casting machine that has an adjustable width mold that defines a casting passage therein and a foot guide assembly that is proximate to said mold, comprising:

monitoring means for monitoring the relative force that exists between a strand and the foot guide assembly during operation;

analyzing means for analyzing the information obtained by said monitoring means to determine if a condition exists; and process control means for modifying operation of the casting machine in response to the analysis that is performed by said analyzing means, and wherein said process control means, in response to said analyzing means, adjusts the speed by which a mold width change is made.

31. A system according to claim 30, wherein said process control means, in response to said analyzing means, adjusts the speed by which a mold width change is made.

32. A system according to claim 30, wherein said process control means, in response to said analyzing means, adjusts the taper of at least one face of the mold.

33. A system according to claim 30, wherein said process control means, in response to said analyzing means, adjusts the spacing of the foot guide assembly to the centerline of the casting passage of the mold.

34. A system according to claim 30, wherein said process control means, in response to said analyzing means, adjusts the flow of coolant to the mold.

35. A system according to claim 30, wherein said process control means, in response to said analyzing means, adjusts the flow of coolant to cooling sprays that are downstream of the mold.

36. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition relating to damage to the foot guide assembly exists; and (e) alerting an operator to the condition if it is determined to exist.

37. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists; and (e) adjusting the taper of at least one face of the mold in response to the analysis that is performed in step (d).

38. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists; and (e) adjusting the flow of coolant to the mold in response to the analysis that is performed in step (d).

39. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists; and (e) adjusting the flow of coolant to cooling sprays that are downstream of the mold in response to the analysis that is performed in step (d).

40. A method of operating a continuous casting machine that has an adjustable width mold that defines a casting passage therein and a foot guide assembly that is proximate to said mold, comprising steps of:

(a) forming a strand within the casting passage of the mold;

(b) guiding the strand with the foot guide assembly after the strand emerges from the mold;

(c) monitoring the relative force that exists between the strand and the foot guide assembly during operation;

(d) analyzing the information obtained in step (c) to determine if a condition exists; and (e) adjusting the rate at which a strand is withdrawn from the mold in response to the analysis that is performed in step (d).

41. A system for operating a continuous casting machine that has an adjustable width mold that defines a casting passage therein and a foot guide assembly that is proximate to said mold, comprising:

monitoring means for monitoring the relative force that exists between a strand and the foot guide assembly during operation;

analyzing means for analyzing the information obtained by said monitoring means to determine if a condition exists; and process control means for modifying operation of the casting machine in response to the analysis that is performed by said analyzing means, and wherein said process control means, in response to said analyzing means, adjusts the taper of at least one face of the mold.

42. A system for operating a continuous casting machine that has an adjustable width mold that defines a casting passage therein and a foot guide assembly that is proximate to said mold, comprising:

monitoring means for monitoring the relative force that exists between a strand and the foot guide assembly during operation;

analyzing means for analyzing the information obtained by said monitoring means to determine if a condition exists; and process control means for modifying operation of the casting machine in response to the analysis that is performed by said analyzing means, and wherein said process control means, in response to said analyzing means, adjusts the flow of coolant to the mold.

43. A system for operating a continuous casting machine that has an adjustable width mold that defines a casting passage therein and a foot guide assembly that is proximate to said mold, comprising:

monitoring means for monitoring the relative force that exists between a strand and the foot guide assembly during operation;

analyzing means for analyzing the information obtained by said monitoring means to determine if a condition exists; and process control means for modifying operation of the casting machine in response to the analysis that is performed by said analyzing means, and wherein said process control means, in response to said analyzing means, adjusts the flow of coolant to coolant sprays that are downstream of the mold.

* * * * *